US008999899B2

(12) United States Patent
Kaneko

(10) Patent No.: US 8,999,899 B2
(45) Date of Patent: Apr. 7, 2015

(54) LUBRICATING OIL COMPOSITION FOR WORKING USING SIZING PRESS

(75) Inventor: Masato Kaneko, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 1184 days.

(21) Appl. No.: 10/586,635

(22) PCT Filed: Mar. 30, 2005

(86) PCT No.: PCT/JP2005/006042

§ 371 (c)(1),
(2), (4) Date: Jul. 19, 2006

(87) PCT Pub. No.: WO2005/095560

PCT Pub. Date: Oct. 13, 2005

(65) Prior Publication Data

US 2007/0149416 A1 Jun. 28, 2007

(30) Foreign Application Priority Data

Mar. 31, 2004 (JP) ..... 2004-105544

(51) Int. Cl.

| | |
|---|---|
| ***C10M 169/00*** | (2006.01) |
| ***C10M 141/10*** | (2006.01) |
| ***B21J 3/00*** | (2006.01) |
| ***C10M 169/04*** | (2006.01) |

(52) U.S. Cl.

CPC ..... *C10M 141/10* (2013.01); *B21J 3/00* (2013.01); *C10M 169/04* (2013.01); *C10M 2203/065* (2013.01); *C10M 2203/1025* (2013.01); *C10M 2203/1065* (2013.01); *C10M 2205/0265* (2013.01); *C10M 2215/223* (2013.01); *C10M 2219/082* (2013.01); *C10M 2219/106* (2013.01); *C10M 2223/04* (2013.01); *C10M 2223/045* (2013.01); *C10M 2223/049* (2013.01); *C10N 2220/022* (2013.01); *C10N 2230/00* (2013.01); *C10N 2230/06* (2013.01); *C10N 2240/02* (2013.01); *C10N 2240/40* (2013.01)

(58) Field of Classification Search

CPC ..... C10M 169/00
USPC ..... 508/421, 496, 110, 243, 272, 280
See application file for complete search history.

(56) References Cited

U.S. PATENT DOCUMENTS

| | | | | |
|---|---|---|---|---|
| 5,198,129 | A * | 3/1993 | Hata | 508/372 |
| 5,275,630 | A * | 1/1994 | Dorer | 44/341 |
| 5,912,212 | A * | 6/1999 | Igarashi et al. | 508/275 |
| 6,245,725 | B1 * | 6/2001 | Tanaka et al. | 508/365 |
| 6,586,376 | B1 * | 7/2003 | Nakanishi et al. | 508/437 |
| 6,656,887 | B2 * | 12/2003 | Yagishita et al. | 508/371 |
| 2002/0114980 | A1 * | 8/2002 | Gunsel et al. | 428/695 |
| 2003/0153472 | A1 * | 8/2003 | Nagano et al. | 508/496 |
| 2003/0219180 | A1 * | 11/2003 | Huang | 384/279 |
| 2004/0038833 | A1 | 2/2004 | Deckman et al. | |
| 2006/0019840 | A1 * | 1/2006 | Kawahara et al. | 508/280 |
| 2007/0155635 | A1 * | 7/2007 | Tagawa et al. | 508/463 |

FOREIGN PATENT DOCUMENTS

| | | | |
|---|---|---|---|
| JP | 04 314795 | | 11/1992 |
| JP | 04 337091 | | 11/1992 |
| JP | 08 034988 | | 2/1996 |
| JP | 09048989 | A * | 2/1997 |
| JP | 09 222125 | | 8/1997 |
| JP | 10 279979 | | 10/1998 |
| JP | 2003 013084 | | 1/2003 |
| JP | 2004051720 | A * | 2/2004 |
| WO | WO 2004/018595 | A1 | 3/2004 |

OTHER PUBLICATIONS

W. Cubberly, Ramon Bakerjian, Tool and Manufacturing Engineers Handbook, Published by SME, 1989, Society of Manufacturing Engineers, p. 407.*

Office Action issued on Jul. 4, 2011 in the corresponding Korean Patent Application No. 10-2006-7015280.

* cited by examiner

*Primary Examiner* — Taiwo Oladapo

(74) *Attorney, Agent, or Firm* — Oblon, McClelland, Maier & Neustadt, L.L.P.

(57) ABSTRACT

Provided is a lubricating oil composition for sizing which is excellent in machinability and degreasing efficiency and which is excellent in compatibility with an impregnating oil and a sintered metal of oil impregnated bearings. A lubricating oil composition for sizing, including (A) a lubricating base oil having a kinematic viscosity of 0.5 to 100 $mm^2/s$ at 40° C. and compounded therein (B) an extreme-pressure agent in an amount of 0.1 to 10% by mass, and (C) a metal deactivator in an amount of 0.01 to 5% by mass, each based on a total amount of the composition.

9 Claims, No Drawings

LUBRICATING OIL COMPOSITION FOR WORKING USING SIZING PRESS

CROSS REFERENCE TO RELATED APPLICATION

This application is a 371 of PCT/JP05/006042, filed on Mar. 30, 2005, and claims priority of Japanese Patent Application No. 2004-105544, filed on Mar. 31, 2004.

TECHNICAL FIELD

The present invention relates to a lubricating oil composition for sizing and, more specifically, to a lubricating oil composition for use in sizing a sintered metal, particularly a sintered metal for oil impregnated bearings.

BACKGROUND ART

Oil impregnated bearings are cheaper than ball bearings and fluid dynamic bearings and, therefore, are utilized for a number of applications as a substitute for these bearings in electric accessories for automobiles and various electric appliances. The oil impregnated bearings are generally produced through a compacting step, a sintering step, a sizing step, and a cleaning (degreasing) step. In the sizing step, a machining oil of a mineral oil has been hitherto used. The known machining oil, however, is unsatisfactory with respect to the machinability because of failure to form sufficient oil films. Further, because of poor degreasing efficiency, the mineral oil-type machining oil tends to remain in a large amount in the sintered metal. Further, since the remaining oil is poor in compatibility with the impregnated oil and sintered metal used in oil impregnated bearings, generation of sludge is caused.

In this circumstance, there is a demand for a lubricating oil for sizing which exhibits excellent machinability, degreasing efficiency, and compatibility with the impregnated oil and sintered metal used in oil impregnated bearings. With regard to published documents, Patent Document 1 discloses the use of an oil which is the same as a bearing oil. Patent Document 2 discloses a rapeseed oil. There is, however, a room left for the improvement in the known oils with respect to their performance.

[Patent Document 1] JP-A-H06-264110 (page 2)

[Patent Document 2] JP-A-H08-209370 (page 2)

DISCLOSURE OF THE INVENTION

Problems to be Solved by the Invention

The present invention has been made in the above-described circumstance and an object of the present invention is to provide a lubricating oil composition for sizing which is excellent in machinability and degreasing efficiency and which is excellent in compatibility with an impregnated oil and a sintered metal used in oil impregnated bearings.

Means for Solving the Problems

The present inventors have made an intensive study and have found that the object can be effectively achieved by a composition containing a specific, low viscosity lubricating base oil and an extreme-pressure agent and a metal deactivating agent compounded therein in specific amounts. The present invention has been completed on the basis of the above finding.

Thus, the gist of the present invention is as follows:

1. A lubricating oil composition for sizing, comprising (A) a lubricating base oil having a kinematic viscosity of 0.5 to 100 $mm^2/s$ at 40° C., and compounded therein (B) an extreme-pressure agent in an amount of 0.1 to 10% by mass, and (C) a metal deactivator in an amount of 0.01 to 5% by mass, each based on a total amount of said composition.
2. A lubricating oil composition for sizing as defined in 1 above, wherein said extreme-pressure agent, being component (B), is an organic phosphoric acid ester compound and said metal deactivator, being component (C), is a benzotriazole compound and/or thiadiazole compound.
3. A lubricating oil composition for sizing as defined in 1 or 2 above, further comprising (D) anti-oxidizing agent and/or an anti-foaming agent.
4. A lubricating oil composition for sizing as defined in 2 or 3 above, wherein said organic phosphoric acid ester compound, being component (B), has a phosphoric acid residue having a total carbon number of 8 or more.
5. A lubricating oil composition for sizing as defined in any one of 2 through 4 above, wherein said organic phosphoric acid ester compound is a phosphite ester or an acid phosphite ester.
6. A lubricating oil composition for sizing as defined in any one of 1 through 5 above, wherein said lubricating oil composition is used in sizing a sintered alloy for oil impregnated bearings.
7. A method of preparing an oil impregnated bearing, characterized by sizing a sintered alloy with the use of a lubricating oil composition for sizing as defined in any one of 1 through 5 above, followed by degreasing and then impregnating with a bearing oil.
8. A sintered, oil impregnated bearing prepared by a method according to 7 above.

Effect of the Invention

According to the present invention a lubricating oil composition for sizing which is excellent in machinability, degreasing efficiency, and compatibility with an impregnating oil and a sintered metal used in oil impregnated bearings may be provided.

BEST MODE FOR CARRYING OUT THE INVENTION

In the lubricating oil composition for sizing according to the present invention, it is essential that a mineral oil and/or a synthetic oil having a kinematic viscosity in the range of 0.5 to 100 $mm^2/s$ at 40° C. be used as a base oil. A viscosity less than 0.5 $mm^2/s$ is disadvantageous because of a reduction of the strength of oil films and an increase of the loss by evaporation. A viscosity exceeding 100 $mm^2/s$ is not preferable because of a poor degreasing efficiency. The kinematic viscosity is preferably 0.5 to 40 $mm^2/s$, more preferably 0.5 to 10 $mm^2/s$.

Various mineral oils are usable. Examples of such mineral oils include distillate oils obtainable by atmospheric distillation of paraffin base crude oils, intermediate base crude oils or naphthene base crude oils, distillate oils obtainable by vacuum distillation of residual oils of the above atmospheric distillation, and refine oils obtainable by refining the above distillate oils in a conventional manner, such as solvent refined oils, hydrogenation refined oils, dewaxed oils and clay treated oils. Above all highly refined mineral oils are preferable from the standpoint of oxidization stability.

As the synthetic oil, there may be used, for example, a poly(α-olefin), an olefin copolymer (such as an ethylene-propylene copolymer), a branched polyolefin such as polybutene, polyisobutylene or polypropylene, a hydrogenated product of the above polymer, an alkylbenzene or an alkylnaphthalene. Above all, a hydrogenated product of a branched polyolefin is preferable.

As the base oil in the present invention, the above-described mineral oils may be used singly or in combination of two or more thereof and the above-described synthetic oils may be used singly or in combination of two or more thereof. It is also possible to use one or more mineral oils in conjunction with one or more synthetic oils. The pour point which is an index of the characteristics at low temperatures is not specifically limited but is preferably −10° C. or lower.

As the extreme-pressure agent which is component (B) of the lubricating oil composition for sizing according to the present invention, there may be mentioned, for example, an organic phosphoric acid ester compound.

The organic phosphoric acid ester compound may be a phosphoric acid ester compound including a phosphate ester and an acid phosphate ester, or a phosphorous acid ester compound including a phosphite ester and an acid phosphite ester, which may be represented by the general formulas (I) through (V) shown below. Above all, the phosphorous acid ester compounds including a phosphite ester and an acid phosphite ester are preferable from the standpoint of degreasing efficiency.

(I)

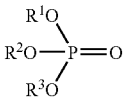

(II)

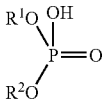

(III)

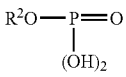

(IV)

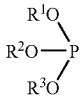

(V)

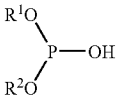

In the above general formulas (I) through (V), $R^1$ to $R^3$ may be same or different and each represent an alkyl group or an alkenyl group having 4 to 30 carbon atoms, an aryl group or an alkylaryl group having 6 to 30 carbon atoms or an aralkyl group having 7 to 30 carbon atoms.

The phosphoric acid residue of the organic phosphoric acid ester compound preferably has a total carbon number of 8 or more. When the total number is 7 or less, there is a possibility that the lubricity is insufficient. The total number is more preferably 12 or more, particularly preferably 18 or more.

The phosphate ester may be an aryl phosphate, an alkyl phosphate, an alkylaryl phosphate, an aralkyl phosphate, alkenyl phosphate or the like. Examples of the phosphate ester include triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate.

Examples of the acid phosphate esters include 2-ethylhexyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite esters include tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenylisodecyl phosphite, tristearyl phosphite, and trioleyl phosphite.

Examples of the acid phosphite esters include dibutyl hydrogen phosphite, dilauryl hydrogen phosphite, dioleyl hydrogen phosphite, distearyl hydrogen phosphite, and diphenyl hydrogen phosphite.

As the organic phosphoric acid ester compound, it is possible to use a phosphonic acid ester such as dioctyl octylphosphonate, and monooctyl octylphosphonate. Among the organic phosphoric acid ester compounds, tri(2-ethylhexyl) phosphate is preferable as the phosphate ester and dioleyl hydrogen phosphite is preferable as the phosphite ester.

The compounds of component (B) may be used singly or in combination of two or more thereof. The amount of component (B) is chosen from the range of 0.1 to 10% by mass based on a total amount of the composition. An amount of the component (B) less than 0.1% by mass causes poor machinability. Too large an amount in excess of 10% by mass causes poor degreasing efficiency. Preferably, the amount is 0.2 to 5% by mass, more preferably 0.5 to 3% by mass.

As the metal deactivator which is component (C) of the lubricating oil composition for sizing according to the present invention, there may be mentioned, for example, a benzotriazole compound and/or thiadiazole compound.

The benzotriazole compound may be benzotriazole or an alkylbenzotriazole represented by the general formula (VI) shown below, an N-(alkyl)alkylbenzotriazole represented by the general formula (VII) shown below, or an N-(alkyl)aminoalkylbenzotriazole represented by the general formula (VIII) shown below.

(VI)

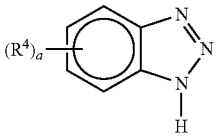

wherein $R^4$ represents an alkyl group having 1 to 4 carbon atoms and a is an integer of 0 to 4.

(VII)

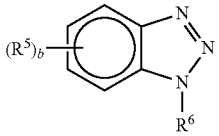

wherein $R^5$ and $R^6$ are same or different and each represent an alkyl group having 1 to 4 carbon atoms and b is an integer of 0 to 4.

(VIII)

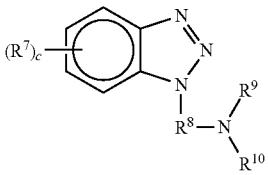

wherein $R^7$ represents an alkyl group having 1 to 4 carbon atoms, $R^8$ represents a methylene group or an ethylene group, $R^9$ and $R^{10}$ are same or different and each represent a hydrogen atom or an alkyl group having 1 to 12 carbon atoms and c is an integer of 0 to 4.

The symbol $R^4$ in the above general formula (VI) represents an alkyl group having 1 to 4 carbon atoms, preferably 1 or 2 carbon atoms. Specific examples of the alkyl group include a methyl group, an ethyl group, an n-propyl group, an isopropyl group, an n-butyl group, an isobutyl group, a sec-butyl group, and a tert-butyl group. The symbol a is an integer of 0 to 4, preferably 0 or 1.

The symbols $R^5$ and $R^6$ in the above general formula (VII) each represent an alkyl group having 1 to 4 carbon atoms, preferably 1 or 2 carbon atoms. Specific examples of the alkyl group are the same as those of $R^4$. The symbol b is an integer of 0 to 4, preferably 0, or 1.

The symbol $R^7$ in the above general formula (VIII) represents an alkyl group having 1 to 4 carbon atoms, preferably 1 or 2 carbon atoms. Specific examples of the alkyl group are the same as those of $R^4$. The symbol $R^8$ represents a methylene group or an ethylene group, preferably a methylene group. The symbols $R^9$ and $R^{10}$ each represent a hydrogen atom, an alkyl group having 1 to 12 carbon atoms, preferably an alkyl group having 1 to 9 carbon atoms. Specific examples of the alkyl group include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, and various dodecyl groups. The symbol c is an integer of 0 to 4, preferably 0 or 1.

As the thiadiazole compound, there may be preferably used, for example, a 1,3,4-thiadiazole, a 1,2,4-thiadiazole or a 1,4,5-thiadiazole represented by the following general formulas (IX).

(IX)

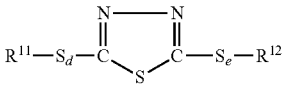

-continued

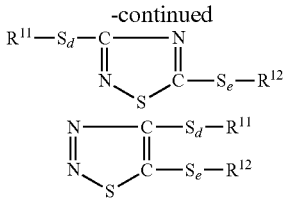

wherein $R^{11}$ and $R^{12}$ each represent a hydrogen atom or an alkyl group having 1 to 20 carbon atoms, and d and e are each an integer of 0 to 8.

Illustrative of suitable thiadiazole compounds are 2,5-bis(n-hexyldithio)-1,3,4-thiadiazole; 2,5-bis(n-octyldithio)-1,3,4-thiadiazole; 2,5-bis(n-nonyldithio)-1,3,4-thiadiazole; 2,5-bis(1,1,3,3-tetramethylbutyldithio)-1,3,4-thiadiazole; 3,5-bis(n-hexyldithio)-1,2,4-thiadiazole; 3,5-bis(n-octyldithio)-1,2,4-thiadiazole; 3,5-bis(n-nonyldithio)-1,2,4-thiadiazole; 3,5-bis(1,1,3,3-tetramethylbutyldithio)-1,2,4-thiadiazole; 4,5-bis(n-hexyldithio)-1,2,3-thiadiazole; 4,5-bis(n-octyldithio)-1,2,3-thiadiazole; 4,5-bis(n-nonyldithio)-1,2,3-thiadiazole; and 4,5-bis(1,1,3,3-tetramethylbutyldithio)-1,2,3-thiadiazole. Above all, 2,5-bis(n-octyldithio)-1,3,4-thiadiazole and 2,5-bis(n-nonyldithio)-1,3,4-thiadiazole are preferable.

Among the metal deactivators of component (C) described above, N-substituted benzotriazoles such as N-methylbenzotriazole and N-dioctylaminomethyl-1,2,3-benzotriazole are preferable from the standpoint of compatibility with an impregnating oil and lubricity.

The above compounds of the component (C) may be used singly or in combination of two or more thereof. The amount of the component (C) is 0.01 to 5% by mass based on a total amount of the composition. An amount of the component (C) less than 0.01% by mass causes poor machinability. Too large an amount in excess of 5% by mass causes poor degreasing efficiency. Preferably, the amount is 0.03 to 3% by mass.

In the lubricating oil composition for sizing according to the present invention, an anti-oxidizing agent and/or anti-foaming agent, being a component (D), may be additionally used, if necessary.

As the anti-oxidizing agent, there may be mentioned an amine-type anti-oxidizing agent, a phenol-type anti-oxidizing agent, and a sulfur-type anti-oxidizing agent.

As the amine-type anti-oxidizing agent, there may be mentioned a monoalkyldiphenylamine-series such as monooctyldiphenylamine or monononyldipheylamine, a dialkyldiphenylamine-series such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine or 4,4'-dinonyldiphenylamine, a polyalkyldiphenylamine-series such as tetrabutyldiphenylamine, tetrahexyldiphenylamine, tetraoctyldiphenylamine or tetranonyldiphenylamine, or a naphthylamine-series such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, or nonylphenyl-α-naphthylamine. Above all, the dialkyldiphenylamine-series is preferable. The above amine-type anti-oxidizing agents may be used singly or in combination of two or more thereof.

The phenol-type anti-oxidizing agent may be, for example, a monophenol-series such as 2,6-di-tert-butyl-4-methylphenol or 2,6-di-tert-butyl-4-ethylphenol, a diphenol-series such as 4,4'-methylenebis(2,6-di-tert-butylphenol) or 2,2'-methylenebis(4-ethyl-6-tert-butylphenol), or a polymer-type phenol-series such as tetrakis[methylene-3-(3,5-di-tert-butyl-4-hydroxyphenyl)propionate]methane. The above phenol-type anti-oxidizing agents may be used singly or in combination of two or more thereof.

As the sulfur-type anti-oxidizing agent, there may be mentioned phenothiazine, pentaerythritol tetrakis(3-laurylthiopropionate), bis(3,5-tert-butyl-4-hydroxybenzyl)sulfide, thiodiethylenebis(3-(3,5-di-tert-butyl-4-hydroxyphenyl)) propionate or 2,6-di-tert-butyl-4-(4,6-bis(octylthio)-1,3,5-triazine-2-methylamino)phenol. These sulfur-type anti-oxidizing agents may be used singly or in combination of two or more thereof.

The above various types of anti-oxidizing agents may be used in combination of two or more thereof.

The amount of the anti-oxidizing agent is in the range of 0.01 to 10% by mass based on a total amount of said composition, preferably 0.03 to 5% by mass.

As the anti-foaming agent, a liquid silicone is suitably used. For example, methyl silicone, fluorosilicone or polyacrylate may be used.

The amount of the anti-foaming agent is 0.0005 to 0.01% by mass based on a total amount of said composition.

In the lubricating oil composition for sizing according to the present invention, an additive or additives such as a friction controlling agent, a cleaning dispersant, a viscosity index improver and a thickener may be compounded, if necessary, as long as the objects of the present invention are not adversely affected.

EXAMPLES

The present invention will be further described with regard to examples but is not restricted to the examples in any way.

Examples 1 to 8 and Comparative Examples 1 to 6

(1) Preparation of Lubricating Oil Composition for Sizing

To the lubricating base oil shown in Table 1, components shown in Table 1 were compounded in amounts (% by mass) shown in Table 1 on the basis of the total amount of the composition, thereby to prepare lubricating oil compositions.

(2) Evaluation Tests as Lubricating Oil for Sizing

The lubricating oil compositions for sizing thus prepared were subjected to evaluation tests in the manner shown below. The results are shown in Table 1.

(a) Lubricity Test (JASO Pendulum Test)

In accordance with JASO M-314 6.13, the test was performed at room temperature to determine the coefficient of friction.

(b) Degreasing Test

A sintered metal impregnated with the oil was subjected to extraction with n-hexane. The residual amount of the oil in the sintered metal after the extraction was measured.

(c) Compatibility Test with an Oil for Impregnation

An impregnation oil and the sizing oil was mixed in a 1:1 (mass ratio) proportion and the mixture was stored at room temperature for one month. Presence or absence of precipitates was checked to evaluate stability of the mixture with the impregnation oil.

(d) Compatibility Test with a Sintered Metal

A sintered metal was immersed in the sizing oil and stored at room temperature for one month. The presence or absence of color change, appearance of the oil, and presence or absence of precipitates were evaluated.

TABLE 1

| | | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Amount (% by mass) | Base oil | A1 | 91 | 95.5 | 97.8 | 98.9 | | | | |
| | | A2 | | | | | 96.9 | | | 96.9 |
| | | A3 | | | | | | 95 | | |
| | | A4 | | | | | | | 99.45 | |
| | | A5 | | | | | | | | |
| | Extreme pressure agent | B1 | 8 | 4 | 2 | 1 | 3 | | | 3 |
| | | B2 | | | | | | 2 | 0.5 | |
| | | B3 | | | | | | | | |
| | | B4 | | | | | | | | |
| | Metal deactivator | C1 | 1 | 0.5 | 0.2 | 0.1 | 0.1 | 0.1 | 0.05 | |
| | | C2 | | | | | | | | |
| | | C3 | | | | | | | | 0.1 |
| Lubricity | JASO pendulum Test | Coefficient of friction | 0.093 | 0.097 | 0.106 | 0.111 | 0.103 | 0.105 | 0.112 | 0.117 |
| Degreasing efficiency | Degreasing Test | Residual amount of Oil (g) | 0.0057 | 0.0023 | 0.0012 | 0.0006 | 0.0017 | 0.0125 | 0.0516 | 0.0014 |
| Compatibility | Compatibility with impregnation oil | Precipitates | none | none | none | none | none | none | none | none |
| | Compatibility with sintered metal | Color change | none | none | none | none | none | none | none | none |
| | | Appearance of oil | good | good | good | good | good | good | good | good |

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Amount (% by mass) | Base oil | A1 | 99.945 | 84 | 90 | | 94.9 | 94.9 |
| | | A2 | | | | | | |
| | | A3 | | | | | | |
| | | A4 | | | | | | |
| | | A5 | | | | 96.9 | | |
| | Extreme pressure agent | B1 | 0.05 | 15 | 4 | 3 | | |
| | | B2 | | | | | | |
| | | B3 | | | | | 5 | |

TABLE 1-continued

| | | | | | | | | |
|---|---|---|---|---|---|---|---|---|
| | | B4 | | | | | | 5 |
| | Metal deactivator | C1 | 0.005 | 1 | | 0.1 | 0.1 | |
| | | C2 | | | 6 | | | 0.1 |
| | | C3 | | | | | | |
| Lubricity | JASO pendulum Test | Coefficient of friction | 0.135 | 0.093 | 0.107 | 0.101 | 0.142 | 0.11 |
| Degreasing efficiency | Degreasing Test | Residual amount of Oil (g) | 0.0003 | 0.0128 | 0.116 | 0.172 | 0.0198 | 0.0015 |
| Compati-bility | Compatibility with impreg-nation oil | Precipitates | none | none | form | none | form | form |
| | Compatibility with sintered metal | Color change Appearance of oil | none good | none discolor | none Preci-pitate | none good | change discolor | change discolor |

Remarks:
Components of lubricating oil composition:
A1: Hydrogenated product of polyisobutene; Kinematic viscosity: 1.25 $mm^2/s$ at 40° C.
A2: Naphthene base mineral oil; Kinematic viscosity: 0.98 $mm^2/s$ at 40° C.; Sulfur content: 10 ppm or less
A3: Paraffin base mineral oil; Kinematic viscosity: 8.38 $mm^2/s$ at 40° C. Sulfur content: 10 ppm or less
A4: Alkylbenzene; Kinematic viscosity: 56 $mm^2/s$ at 40° C.
A5: (comparative): Paraffin base mineral oil; Kinematic viscosity: 131 $mm^2/s$ at 40° C. Sulfur content: 950 ppm
B1: Dioleyl hydrogen phosphite
B2: Tri(2-ethylhexyl) phosphate
B3 (comparative): Dioctylpolysulfide
B4 (comparative): ZnDTP
C1: N-dioctylaminomethyl-1,2,3-benzotriazole
C2: Benzotriazole
C3: 2,5-bis(n-nonyldithio)-1,3,4-thiadiazole

INDUSTRIAL APPLICABILITY

The oil impregnated bearing may be prepared by sizing a sintered alloy with the use of the lubricating oil composition for sizing according to the present invention, followed by degreasing and impregnating with a bearing oil.

I claim:

1. A lubricating oil composition, consisting of:

(A) a lubricating base oil having a kinematic viscosity of 0.98 to 56 $mm^2/s$ at 40° C., which is selected from the group consisting of a hydrogenated product of polyisobutene, a naphthene base oil, a paraffin base mineral oil, alkylbenzene, and a combination thereof, and is present in an amount of from 91 to 99.45% by mass;

(B) dioleyl hydrogen phosphite, present in an amount of 1 to 8% by mass; and (C) at least one metal deactivator selected from the group consisting of N-dioctylaminomethyl-1,2,3-benzotriazole, benzotriazole, 2,5-bis(n-nonyldithio)-1,3,4-thiadiazole, and a combination thereof, which is present in an amount of 0.05 to 1% by mass, wherein the amount of each of components (A) to (C) is based on a total amount of said lubricating oil composition.

2. The composition according to claim 1, wherein component (A) is a hydrogenated product of polyisobutene.

3. The composition according to claim 2, wherein component (C) is N-dioctylaminomethyl-1,2,3-benzotriazole or 2,5-bis(n-nonyldithio)-1,3,4-thiadiazole.

4. The composition according to claim 1, wherein component (C) is N-dioctylaminomethyl-1,2,3-benzotriazole.

5. The composition according to claim 1, wherein component (C) is 2,5-bis(n-nonyldithio)-1,3,4-thiadiazole.

6. The composition according to claim 1, wherein component (A) is a naphthene base oil.

7. The composition according to claim 1, wherein component (A) is a paraffin base mineral oil.

8. The composition according to claim 1, wherein component (A) is alkylbenzene.

9. The composition according to claim 1, wherein component (A) is two or more members selected from the group consisting of a hydrogenated product of polyisobutene, a naphthene base oil, a paraffin base mineral oil, and alkylbenzene.

* * * * *